United States Patent [19]

Smith

[11] Patent Number: 4,514,101

[45] Date of Patent: Apr. 30, 1985

[54] PAPER THICKNESS ADJUSTING MECHANISM FOR IMPACT PRINTER

[75] Inventor: Henry E. Smith, Pleasanton, Calif.

[73] Assignee: Xerox Corporation, Stamford, Conn.

[21] Appl. No.: 561,266

[22] Filed: Dec. 14, 1983

[51] Int. Cl.[3] ..... B41J 11/20

[52] U.S. Cl. ..... 400/59; 400/354

[58] Field of Search ..... 400/55–60, 400/352, 354–357

[56] References Cited

U.S. PATENT DOCUMENTS

| | | | |
|---|---|---|---|
| 1,620,004 | 3/1927 | Block | 400/357 |
| 2,986,259 | 5/1961 | Salzberger | 400/59 |
| 3,123,194 | 3/1964 | Facins et al. | 400/355 |
| 3,666,071 | 5/1972 | Purr | 400/59 |
| 3,960,256 | 6/1976 | Bickoff et al. | 400/724 |
| 4,243,331 | 1/1981 | Savage et al. | 400/59 |
| 4,381,896 | 5/1983 | Shiurila | 400/59 |
| 4,412,704 | 11/1983 | Gagnebin | 400/354.1 |
| 4,469,459 | 9/1984 | Trezise et al. | 400/59 |

FOREIGN PATENT DOCUMENTS

| | | | |
|---|---|---|---|
| 5142679 | 11/1980 | Japan | 400/59 |
| 57-98378 | 6/1982 | Japan | 400/56 |

*Primary Examiner*—William Pieprz

*Attorney, Agent, or Firm*—Serge Abend

[57] ABSTRACT

An improved printer for accommodating and printing upon, a broad range of record medium thicknesses, including multi-part forms, while maintaining high print quality. The printer includes a platen and a pair of guide rails having a fixed relationship to one another, and an adjustable marking module supported for movement along the guide rails. An adjustment mechanism for adjusting the clearance between the platen and the marking module includes a toggle bracket for allowing the front of the module to pivot about the guide rail closest to the platen and for allowing the rear of the module to be moved relative to the furthest guide rail.

3 Claims, 6 Drawing Figures

PAPER THICKNESS ADJUSTING MECHANISM FOR IMPACT PRINTER

Figure 1:
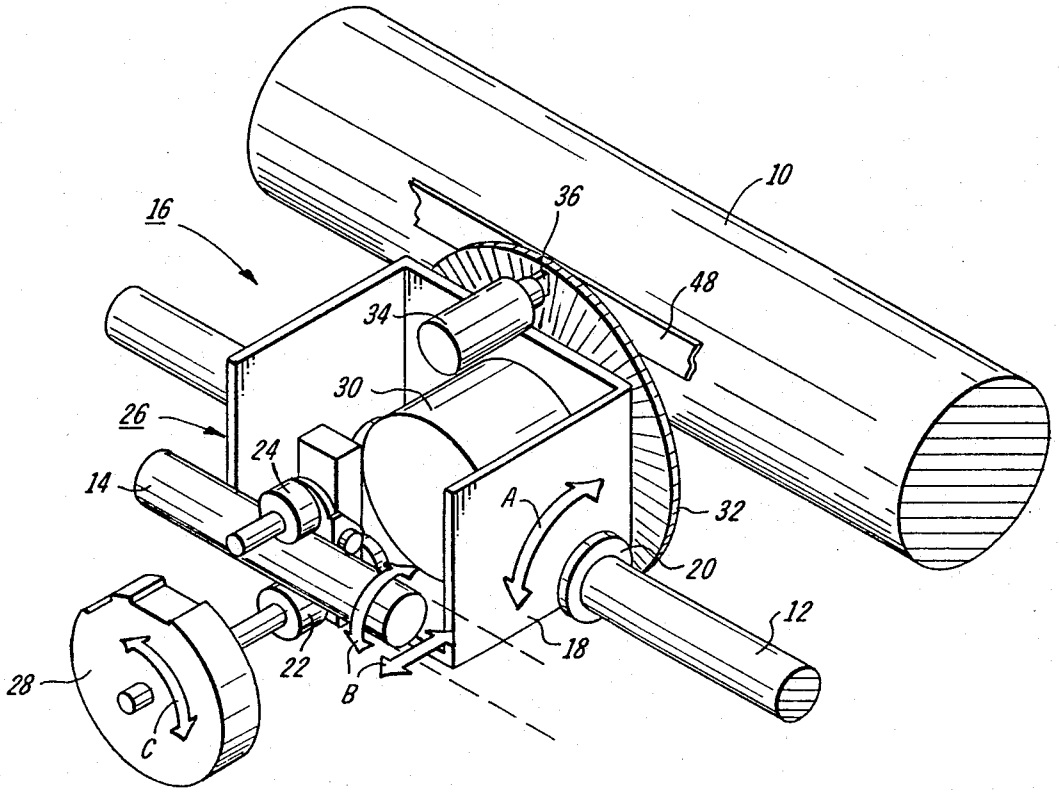

The present invention relates to an improved impact printer and, more particularly, to a mechanism for simply, inexpensively and accurately establishing and adjusting the clearance between the platen and the marking module thereof. A fixed relationship is maintained between the platen and each of the marking module guide rails and an adjustment mechanism including a toggle bracket allows the module to be pivoted about the guide rail closest to the platen. In this manner, the improved printer may accommodate and print upon, a broad range of record medium thicknesses, including multi-part forms, while maintaining high print quality.

In impact printers, such as daisy wheel printers, wherein formed character elements upon a printwheel are impacted and driven toward a platen by a hammer mechanism, or pin matrix printers wherein characters are formed as selected combinations of reciprocating pins are driven toward a platen, a significant determinant of output print quality is the size of the gap between the surface of the image receptor sheet, held against the platen, and the impacting element. Deviations from an optimal distance will either cause the impression to be too light, if the distance is too great, or may emboss the receptor sheet, if the distance is too small. If it is desired that the printer be capable of accepting and providing uniform print quality upon receptor sheets of varying thicknesses or, more critically, upon multi-part forms which may vary from two-ply to six-ply, or greater, it is necessary to provide the printer with a capability for the operator to adjust the gap in accordance with the receptor material used in order to maintain the predetermined optimal distance. Without such an adjustment, extremely thick forms, can present a more critical problem. When introduced into the printer, mechanical interference with the impact mechanism itself could cause the printwheel, which normally rotates at extremely high speeds, to bind and even to be destroyed.

Various approaches for effecting sheet thickness adjustments in impact printers are known in the patent literature. One such approach is typified by the disclosure of U.S. Pat. No. 4,365,900 (Gottsmann et al) wherein an adjusting lever is utilized to move a frame, carrying the platen, toward and away from the marking module. Another approach is dislosed in U.S. Pat. No. 4,268,177 (Veale) wherein an adjusting lever, through a linkage arrangement, repositions the marking module rear guide rail for pivoting the printing mechanism about the front guide rail and moving it toward and away from the platen. Also, in U.S. Pat. No. 4,384,794 (Okano et al.) the front guide rail is moved in an arc and carries with it the marking module support. In each of these approaches, adjustments are made to elements which, preferably, should be fixed in order to obtain and maintain optimum print quality for the life of the product. The precise location of and parallelism between the platen and the marking module guide rails establishes the location in space of the print line. It is imperative, for optimum print quality, that the print line lies axially upon the surface of the platen. By adjusting these elements during usage, deterioration in print quality may be expected. Therefore, it is preferable to align these elements during manufacture and not to tamper with their positioning in any way during usage.

An alternative approach which follows this line of reasoning is disclosed in U.S. Pat. No. 4,390,292 (Krenz). The marking module support carriage is moved relative to its respective carriage support rails, toward and away from a fixed platen, but in so doing the carriage is not firmly connected to its support and the print point may wander during repositioning. Furthermore, this approach would not be totally practical for a daisywheel printer since the translational repositioning movement would change the geometric relationship between the curvature of the character pad and that of the surface of the record medium.

It is the object of the present invention to provide a paper thickness adjustment mechanism for an impact printer, in which repositioning of the marking module relative to the platen may be effected precisely and simply by the printer operator.

It is a further object of the present invention to provide a paper thickness adjustment mechanism constructed with a minimum of parts and available at an extremely low cost.

It is a yet another object of the present invention to provide a paper thickness adjustment mechanism in which the platen and the marking module guide rails are fixed relative to one another at all times and that adjustment is effected by pivoting the printing mechanism toward and away from the platen.

These and other objects may be carried out, in one form, by providing an impact printer including a platen, a pair of guide rails positioned parallel to and in fixed relationship to the platen, and a marking module, mounted upon the guide rails for reciprocating movement parallel to the platen. The marking module includes a carriage having a fixed bearing, journalled for translational and rotational movement relative to the guide rail closest to the platen, and a displaceable bearing for translational and cocking movement relative to the guide rail furthest from the platen. As the carriage is rotated relative to the guide rails, the impact elements on the marking module are moved toward and away from the platen. An adjustment mechanism including a toggle bracket allows the rear of the carriage to be displaced relative to the furthest guide rail so that the displaceable bearing may rotate and be laterally displaced about the axis of the furthest guide rail.

Figure 2:
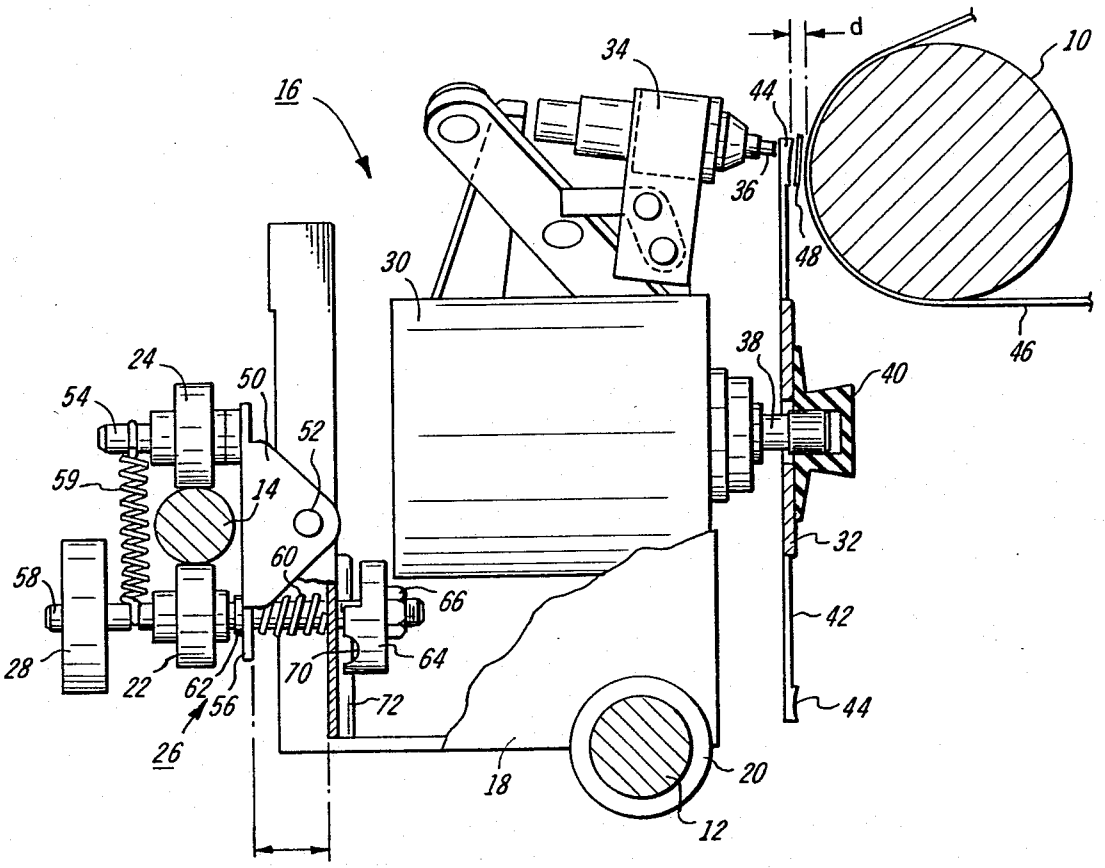
Figure 3:
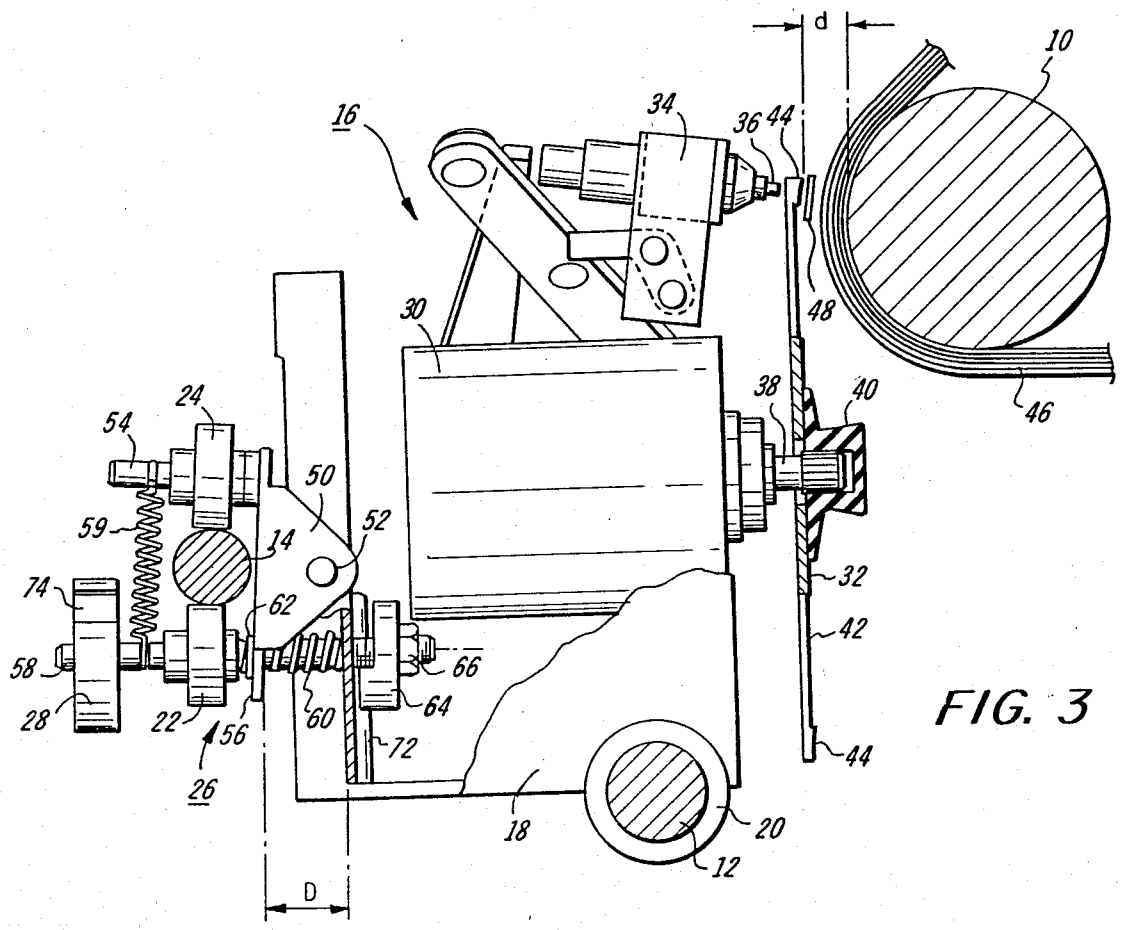
Figure 4:
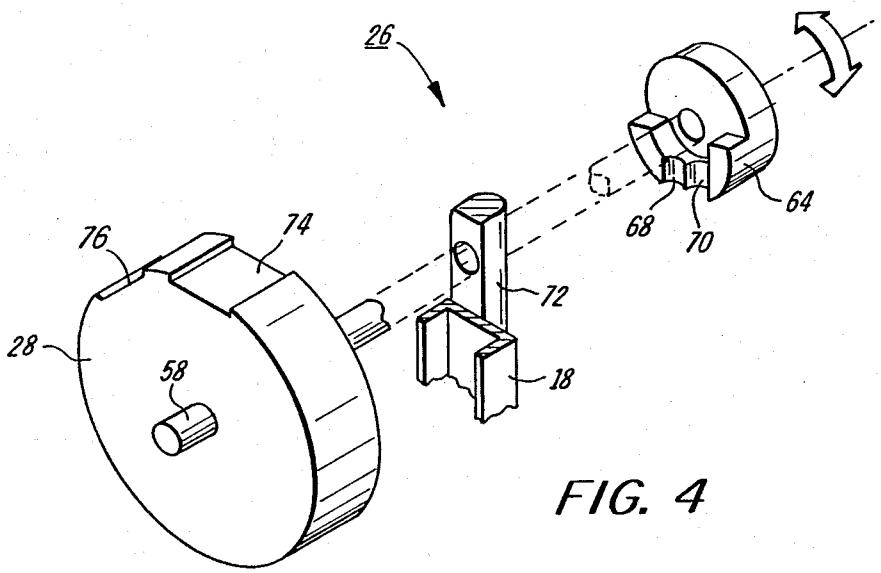
Figure 5:
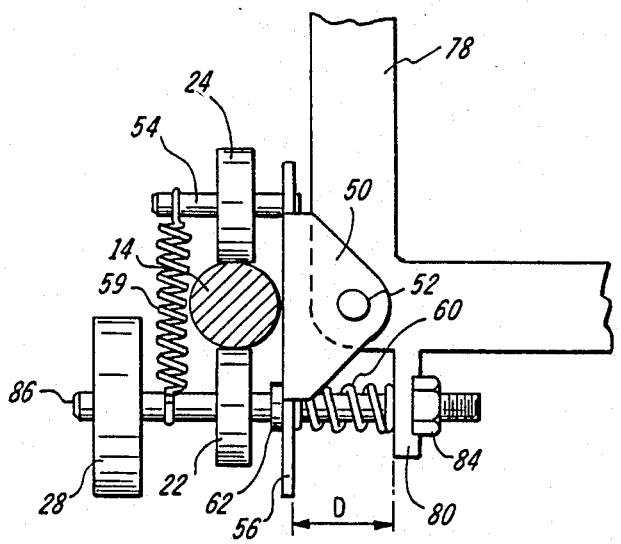
Figure 6:
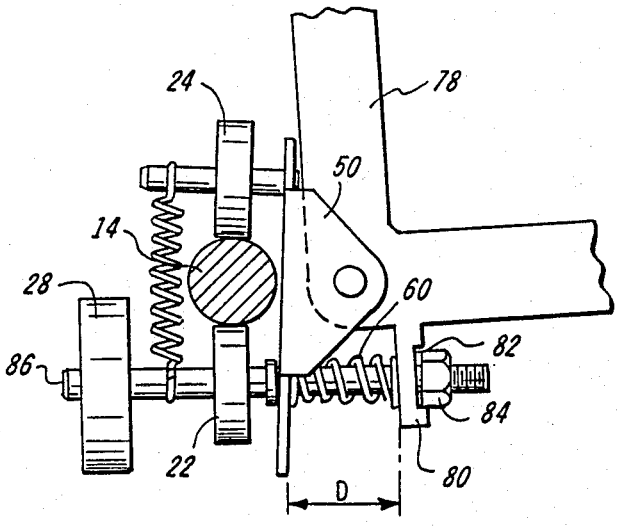

The advantages of the present invention will be understood by those skilled in the art through the following detailed description when taken in conjunction with the accompanying drawings, in which:

FIG. 1 is a perspective view showing the relationship of the platen, the guide rails, the marking module and the adjustment mechanism used therewith, FIG. 2 is a side elevation view showing one form of the adjusting mechanism, in a first position, FIG. 3 is a side elevation view similar to that of FIG. 2 showing the adjusting mechanism, in a second position, FIG. 4 is an exploded perspective view showing a portion of the adjusting mechanism of FIG. 2, FIG. 5 is a partial side elevation view showing an alternative form of the adjusting mechanism of the present invention, in a first position, and FIG. 6 is a side elevation view similar to that of FIG. 5 showing the adjusting mechanism in a second position.

With particular reference to the drawings, there is illustrated in FIG. 1 the marking portion of an daisywheel impact printer. A platen 10 is accurately and rigidly mounted for rotation within a machine frame (not shown) which also supports accurately and rigidly mounted marking module guide rails 12 and 14. The marking module 16, including a support carriage 18, is mounted primarily for reciprocating movement, parallel to the axis of the platen, upon the guide rails 12 and 14. It is also mounted to pivot about the rails 12.

The support carriage includes a pair of bearings 20 (only one is shown) which are mounted upon the front guide rail 12. It is supported for movement along rear guide rail 14 by a pair of rollers 22 and 24 which are designed for bearing the necessary carriage supporting load even when displaced relative to the axis of the rail 14. An image receptor thickness adjusting mechanism 26, controlled by a knob 28, accessible to the machine operator, effects adjustment in a manner to be fully described.

Also forming part of the illustrated marking module 16 are a printwheel drive motor 30, a printwheel 32, a hammer driver 34 and a hammer impact element 36. Turning to FIG. 2, it can be seen that the printwheel drive motor 30 includes a shaft 38 extending outwardly therefrom upon which the mounting hub 40 of printwheel 32 is seated. As is commonly known, the printwheel comprises a plurality of radial spokes or petals 42 at whose ends are provided shaped characters 44. During the printing operation, each selected character is sequentially impacted by the hammer element 36, which drives the characters against the record medium 46 wrapped upon platen 10. An ink releasing ribbon 48 interposed between the character and the record medium will release ink to the surface of the record medium upon impact. It should be noted that the surface of the character pad is curved to mate with the curvature of the record medium upon the platen. During manufacture of the printer this geometric relationship is fixed. It is desirable that the adjustment mechanism maintain this important relationship.

It is well known that the length of the hammer stroke is one of the important parameters in assuring optimum image quality. The hammer will flex the printwheel spoke a given angular amount and move the character pad a given distance. If, however, this stroke is too short, as would be the case with a very thick record medium or a multiple sheet form, too much energy may be imparted to the character causing the printed image to be embossed on the record medium. Alternatively, if the stroke is too great, insufficient energy will be imparted to the record medium and the printed image will be too light. As it would be impractical to adjust the hammer stroke for different thicknesses of record medium, the preferred adjustment allows the operator to move the entire marking module, toward and away from the platen. It is the intent of the present invention to allow the printer operator to make the necessary adjustments, quickly and easily, in order to establish the proper distance "d" between the record medium 46 and the printwheel 32.

The adjustment is accomplished by means of the adjusting mechanism 26 which causes the front of the carriage 18 to tilt toward or away from the platen 10 as it pivots about the axis of front guide rail 12 (arrow A). As the carriage pivots about the front guide rail, the rollers 22 and 24 will be displaced about the axis of the rear guide rail 14 by a combination of rotary and lateral shifting (arrows B). These movements are controlled by and are in response to turning of the control knob 28 (arrow C). Thus, as the carriage is pivoted in the counterclockwise direction, as viewed in FIG. 3, the printwheel 32 will be moved away from the platen 10. Conversely, when the carriage is pivoted in the clockwise direction, the printwheel will be moved toward the platen.

In order to allow the carriage to pivot about guide rail 12, it should be clear that the bearing rollers 22 and 24 riding on the rear guide rail 14 must be free to shift laterally upon the rail. This is accomplished by means of a pivoting toggle bracket 50 mounted upon the carriage 18 by means of pivot pin 52. The toggle bracket supports the upper roller 24 upon a stub shaft 54. A lower extension 56 of the toggle bracket is provided with an oversize opening (not shown) through which an adjustment shaft 58 passes. Lower roller 22 and control knob 28 are supported upon the adjustment shaft. However, since the adjustment shaft is not positively secured to the carriage, a tension spring 59 is provided between the stub shaft 54 and the adjustment shaft 58 for urging the rollers 22 and 24 together upon the guide rail 14.

A compression spring 60 encircles the adjustment shaft, with one end biased against a wall of the carriage 18 and the opposite end biased against the lower extension 56 of toggle bracket 50, urging it against stop 62. By changing the distance "D", between the extension 56 and the carriage 18, the carriage is caused to pivot about guide rail 12. The distance "D" increases as the carriage pivots in a counterclockwise direction, increasing the gap "d" between the printwheel 32 and the platen 10. Conversely, the distance "D" decreases as the carriage pivots in a clockwise direction, decreasing the gap "d". These changes are readily seen in FIGS. 2 and 3.

A cam 64 is threadedly secured upon the end of the adjustment shaft, opposite the control knob 28, and is held securely in place by a locknut 66, so that the cam will rotate with the shaft 58. As best seen in FIG. 4, the cam includes a shallow indentation 68 and a deep indentation 70, each of a concavity designed to receive the curved outer surface of a detent formation 72 on the carriage. As the compression spring 60 biases the lower extension 56 away from the carriage 18 it will draw the selected cam indentation toward the formation 72, holding the cam securely in place.

In the FIG. 2 position, cam 64 is shown with its shallow indentation 68 aligned with detent formation 72 resulting in a positioning of the printwheel 32 close to the platen 10. In the FIG. 3 position, cam 64 is shown with its deep indentation 70 aligned with detent formation 72, resulting in an increase of dimensions "D" and "d". It should be understood that if finer adjustments were required, more indentations could be provided in the cam 64.

Flats 74 and 76 on control knob 28 are provided to bear suitable legends relating the angular position of the knob to the position of the cam. For example, the operator may select "1–3 sheets" (shallow indentation 68) or "4–6 sheets" (deep indentation 70). A total angular displacement of about 45° enables this quick and simple adjustment.

Turning to FIGS. 5 and 6 there is illustrated an alternative embodiment of the present invention. As many of the elements are identical, the same numbers will be used to identify them. In this embodiment, an infinite position arrangement is enabled, instead of the limited preselected position capability of the preferred embodiment. However, greater rotation of the control knob 28 is necessitated.

The carriage 78 is supported for lateral movement on similarly fixed guide rails (only rail 14 shown). A lug formation 80 depends from the carriage and is provided with a cavity 82 formed to receive a nut 84 threadedly mounted upon the adjustment shaft 86. Compression spring 60 encircles the adjustment shaft. One end of the spring biases the lower extension 56 of pivoting toggle bracket 50 against stop 62 and the opposite end is biased against the lug formation 80. The biasing action of the spring causes the nut 84 to be securely drawn into the cavity 82.

Thus, as the control knob 28 is manually rotated by the operator, the adjustment shaft 58 rotates, moving in and out of fixed nut 84 and increasing and/or decreasing the distance "D" between the toggle bracket 50 and the lug formation 80. Variation in the distance "D" causes the carriage to pivot about rail 12 (not shown) changing the distance "d" between the printwheel and the platen, in a manner fully described above with reference to the preferred embodiment of FIGS. 1–4. It should be apparent, however, that while the adjustment mechanism described in the FIGS. 5 and 6 embodiment will enable the operator to more finely tune the distance "d", it will require substantially greater rotation of the adjusting shaft, in accordance with the thread pitch.

In summary, it can be seen that the present invention has provided a unique adjustment device whose operation is more direct and less prone to failure than are the above-described patented alternative systems, whose cost of manufacture is greatly reduced by its simple design and whose ease of use by the printer operator is significant. This has been accomplished within the constraints of maintaining a fixed relationship between the platen 10 and both of the guide rails 12 and 14. The marking module carriage 18 is allowed to pivot about the front guide rail 12 for maintaining the geometric relationship between the printwheel character pads 44 and the surface of the record medium 46. To this end, the adjustment device 26 relies upon a pivoting toggle bracket arrangement which allows the rear of the carriage to be displaced relative to the rear guide rail 14. In so doing, the bearing rollers 22 and 24 rotate and are laterally displaced about the axis of guide rail 14.

It should be understood that the present disclosure has been made only by way of example and that numerous changes in details of construction and the combination and arrangement of parts may be resorted to without departing from the true spirit and the scope of the invention as hereinafter claimed.

What is claimed is:

1. An impact printer comprising a platen, a pair of fixed guide rails positioned parallel to one another and said platen, a marking module including first bearing means for supporting said module upon one of said guide rails and second bearing means for supporting said module upon the other of said guide rails, said first and second bearing means supporting said module for reciprocating movement parallel to said platen, and including adjustment means for pivoting said first bearing means about the axis of said one of said guide rails, and for causing said second bearing means to rotate and to be laterally displaced about the axis of said other of said guide rails, said adjustment means being characterized by including a toggle member including a first section pivotably connected to said marking module, a rotatable shaft acting on a second section of said toggle member for moving said toggle member to shift the position of said marking module, said rotatable shaft being substantially normal to said guide rails, said second bearing means including a first portion supported upon said toggle member, and a second portion supported upon said rotatable shaft, said first and second bearing portions opposing one another on opposite sides of said other of said guide rails, biasing means for urging said first and second bearing portions toward one another, resilient means for separating said marking module from said second section of said toggle member, and control means secured upon said rotatable shaft for adjusting the distance of separation between said marking module and said second section of said toggle member upon rotation of said shaft, said control means comprising positioning means and a control knob for locating said positioning means.

2. The impact printer as defined in claim 1 further characterized in that said positioning means comprises a cam fixedly located on said rotatable shaft and having a plurality of cam surface indentations, said marking module includes fixed detent means thereon located and shaped for mating with said cam indentations, and said resilient means comprises a spring encircling said rotatable shaft, said spring urging said cam indentations toward said detent means.

3. The impact printer as defined in claim 1 further characterized in that said positioning means comprises a threaded portion of said rotatable shaft and a nut in threaded engagement with said shaft threads.

capturing means are provided on said marking module for receiving said nut and preventing rotation thereof, and said resilient means urges said nut into engagement with said capturing means.

* * * * *